US006021643A

United States Patent [19]

Swift et al.

[11] Patent Number: 6,021,643

[45] Date of Patent: Feb. 8, 2000

[54] PULSE TUBE REFRIGERATOR WITH VARIABLE PHASE SHIFT

[75] Inventors: Gregory W. Swift, Santa Fe; David L. Gardner, Los Alamos, both of N.Mex.

[73] Assignee: The Regents of the University of California, Los Alamos, N.Mex.

[21] Appl. No.: 09/041,374

[22] Filed: Mar. 11, 1998

Related U.S. Application Data

[63] Continuation of application No. 60/020,676, Jul. 1, 1996

[60] Provisional application No. 08/853,190, May 5, 1997.

[51] Int. Cl.[7] ..... F25B 9/00

[52] U.S. Cl. ..... 62/6

[58] Field of Search ..... 62/6, 467

[56] References Cited

U.S. PATENT DOCUMENTS 5,247,799 9/1993 Lindl ..... 62/6

5,269,147 12/1993 Ishizaki et al. ..... 62/6

5,295,355 3/1994 Zhou et al. ..... 62/6

*Primary Examiner*—William Doerrler

*Attorney, Agent, or Firm*—Ray G. Wilson

[57] ABSTRACT

An orifice pulse tube refrigerator (PTR) having a pulse tube and a reservoir with a compliance value C is provided with a variable acoustic impedance connecting the pulse tube and the reservoir. The variable acoustic impedance includes two or more variable impedances, which may be an inertance and valves forming variable resistive members, wherein the resulting acoustic impedance has a phase angle that is variable for improved cooling efficiency. The inertance may also be variable to further provide for varying the phase angle. In another improvement, an acoustic transmission line connects the pulse tube and a driver unit for recovering power from the pulse tube for return to the driver to further increase the PTR operating efficiency.

9 Claims, 7 Drawing Sheets

PULSE TUBE REFRIGERATOR WITH VARIABLE PHASE SHIFT

This application claims the benefit of U.S. Provisional Application Ser. No. 60/020,676, filed Jul. 1, 1996, and U.S. patent application Ser. No. 08/853,190, filed May 8, 1997, now abandoned, and incorporated herein by reference.

BACKGROUND OF THE INVENTION

This invention relates to refrigeration devices for operating at cryogenic temperatures, and, more particularly, to orifice pulse tube cryocoolers. This invention was made with government support under Contract No. W-7405-ENG-36 awarded by the U.S. Department of Energy. The government has certain rights in the invention.

Significant effort has been expended to develop efficient and reliable cryocoolers for many applications where cryogenic temperatures are needed. Initially, development was driven by defense needs for effective optical sensors in the IR spectrum. Commercial electronics companies have recently funded cryocooler development in order to access the capabilities of cryogenic CMOS circuitry and the potential capabilities of high temperature superconductors operating at liquid nitrogen (as opposed to liquid helium) temperatures. Many designs and products for both Stirling engine coolers and orifice pulse tube coolers have been developed and applied. In general, Stirling devices have been found to be more efficient (a factor of 2 is quoted in some literature) than orifice pulse tube cooler devices. However, the orifice pulse tube approach has better reliability due to fewer moving parts (in some designs, no moving parts). In many applications, the vibrations from a Stirling device are unacceptable and the orifice pulse tube is the preferred approach.

The cryogenic/liquefied industrial gases industry consists of the liquefaction/separation of air, the liquefaction of hydrogen, the liquefaction of helium, and the liquefaction of petroleum gases. The majority of liquefied gas product is formed in large-scale plants where energy consumption and power efficiency are important concerns. While the overall cycle from raw material to final, purified liquid varies dramatically across this set of gases (and from plant to plant in some gases), the cycle invariably includes a final expansion cooling process to form the liquefied gas.

Air liquefaction plants use an isentropic expansion step for the final cooling. In this approach, the pre-cooled, compressed gas is expanded through a turbine. By performing work in passing through the turbine, a high degree of cooling of the gas is ensured. The turbine drives a compressor that compresses the overhead gas (that part of the gas flow that did not condense during expansion) prior to re-injecting it into the liquefaction flow stream. Most research on improving gas liquefaction technology appears to focus on improving the design of the turbo-expanders to achieve better work extraction and improved condensation.

In the liquefied natural gas market, a few establishments use refrigeration machines to cool and condense the product gas. These refrigeration-based systems use proprietary mixtures of light hydrocarbons (propane, ethylene, methane) whose refrigeration cycle is intricately integrated with the cooling of the natural gas (from which these refrigerator working fluids are originally obtained). It is possible that these refrigerants could be replaced by cryocoolers provided the overall process obtains adequate condensation efficiency.

Applications of cryocooling to superconductors fall into two groups: cooling of electronic components incorporating superconductors and cooling of large scale superconductor windings used as electromagnets in such devices as MRIs, NMR, particle accelerators, and power generators. Applications for these components include the power industry, the medical/diagnostic industry, the analytical instrument industry, and the high energy physics industry. Essentially all existing devices use a passive cryogen supply system in which the superconductor is supplied with cryogen from a reservoir. The reservoir must be periodically resupplied by a liquified gas supply company.

For purposes of comparison to a pulse tube refrigerator (PTR), a Stirling refrigerator may be regarded as consisting of several aligned components: hot compressor piston, hot heat exchanger, regenerator, cold heat exchanger, and cold expander piston. A conventional PTR 10 shown in FIG. 1A operates similarly, except that the cold expander piston is replaced with four stationary components: pulse tube 24 with heat exchanger 26, orifice 12, and reservoir 28. Hot compressor piston 14, hot heat exchanger 16, regenerator 22, and cold heat exchanger 18 complete PTR 10. Stirling refrigerators are more efficient than PTR refrigerators for three reasons. First, work is absorbed and dissipated into waste heat in orifice 12 of PTR 10, whereas work is efficiently recovered at the cold expander piston of the Stirling refrigerator and delivered back to the hot compressor piston. Second, the effective thermal conductance of pulse tube 24 often puts a greater thermal load on cold heat exchanger 18 than does the heat generated by friction and other losses at the cold expander piston in the Stirling refrigerator. Third, control of the time-phase relationship between mass flow and pressure is easily accomplished in the Stirling refrigerator, but is limited in the PTR. In the Stirling refrigerator, mass flow phase leads the pressure phase at the hot heat exchanger and lags pressure phase at the cold heat exchanger. In conventional PTRs the mass flow phase lags the pressure phase at both the hot heat exchanger 16 and cold heat exchanger 18, as shown in FIG. 1B.

This occurs because reservoir 16 is typically large enough to comprise a negligible impedance, and orifice 12 is a resistive impedance, so that the mass flow and pressure are in phase at heat exchanger 26, as seen in FIG. 1B. The compressibility of the gas in pulse tube 24 causes the mass flow phase at cold heat exchanger 18 to lead that at heat exchanger 26; similarly, the compressibility of the gas in regenerator 22 causes the mass flow phase at hot heat exchanger 16 to lead that at cold heat exchanger 18.

K. Kanao et al., "A Miniature Pulse Tube Refrigerator for Temperatures below 100 K," 34 Cryogenics, ICEC Supplement, pp.167–169 (1994), reports that a PTR orifice can be replaced with a small tube connecting the pulse tube with the reservoir, where the flow impedance between the pulse tube and the reservoir is adjusted by selecting tubes of differing diameter and length to optimize PTR performance. Zhu et al., "Phase Shift Effect of the Long Neck Tube for the Pulse Tube Refrigerator," Proceedings of the $9^{th}$ International Cyrocoolers Conference held June 1996 (Preprint—to be published), further discusses the effect of a long neck tube inserted between the pulse tube hot end and the reservoir. Replacing the orifice with a long neck tube is taught to produce a pressure-mass flow phase shift that can be changed by changing the diameter and length of the long neck tube. It will be appreciated that these references discuss only the effect of replacing conventional orifice 12 with a long neck tube connecting pulse tube 24 with reservoir 28. While PTR performance optimization is discussed, there is no discussion or analysis relating to the optimization. In accordance with the present invention, the effect of acoustic impedance on PTR performance is analyzed and a variable acoustic impedance is introduced to optimize PTR performance.

Accordingly, it is an object of the present invention to control the phase relationship between mass flow and pressure to improve the operating efficiency of a PTR.

Yet another object of the present invention is to recover power from the orifice end of the PTR.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention may comprise a PTR having a pulse tube and a reservoir with a compliance value C. A variable acoustic impedance connects the pulse tube and the reservoir. The variable acoustic impedance includes a tube member that forms an inertance having a value L and a first variable acoustic resistance having a value $R_s$, wherein the acoustic impedance formed by the values C, L, and $R_s$ has a phase angle between acoustic pressure and mass flow that is variable to achieve optimum cooling efficiency.

In another aspect of the present invention, an acoustic transmission line connects the pulse tube and the driver for returning power from the pulse tube to the driver to further increase the PTR operating efficiency.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION OF THE INVENTION

In efficient Stirling-cycle cryocoolers, the phase angle for the oscillating mass flow leads the phase angle for the oscillating pressure at the hot end of the Regenerator, and lags behind the pressure phase at the cold end. In orifice pulse tube refrigerators (PTRs), the mass flow phase angle leads the pressure phase angle at both ends of the regenerator, resulting in lower efficiency. The phase shift between oscillating pressure and oscillating mass flow at the cold end of the regenerator is determined in part by the purely resistive nature of the "orifice" of the orifice pulse tube refrigerator, so that the pressure difference across the orifice is in phase with the mass flow through it. In accordance with our invention, the phase shift between mass flow and pressure at the cold end is shifted to the more efficient Stirling values by adding an inertance in series with the orifice. The word "inertance" is an acoustics term connoting both inertia and inductance, because it is due to inertial effects of moving gas and is the acoustic analog of electrical inductance. In a further aspect of our invention, power previously dissipated in the orifice can be recovered by the system compressor through inertial effects in an acoustic transmission line.

Figure 1A:
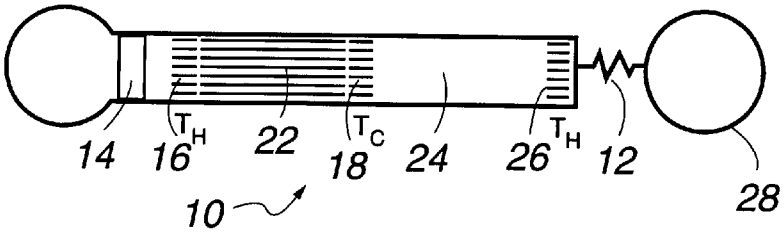
Fig. 1A (Prior Art)

As illustrated in FIG. 1A, the conventional orifice pulse tube refrigerator 10 (PTR) may be regarded as a conventional Stirling refrigerator in which the cold moving parts have been replaced by stationary components. The cold-end piston of the Stirling refrigerator is replaced with pulse tube 24, hot heat exchanger 26, orifice 12, and reservoir 28. Energy is supplied by compressor 14, which may be a conventional piston engine or a thermoacoustic engine. The basic operation of a PTR is reviewed in R. Radebaugh, "A Review of Pulse Tube Refrigeration," 35 Adv Cyrogenic Eng., pg. 1191 (1990).

Figure 1B:
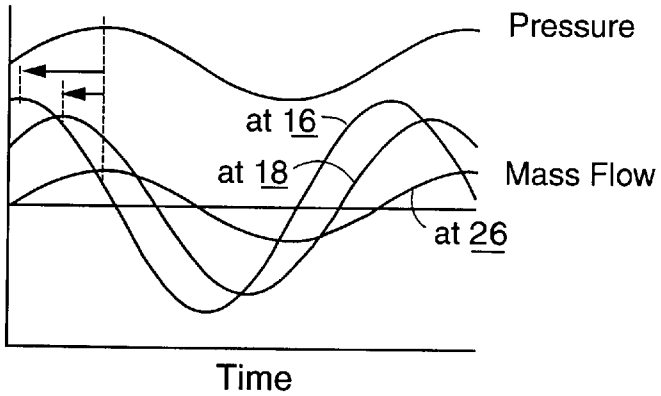
Fig. 1B (Prior Art)
FIGS. 1A and 1B depict a prior art PTR and corresponding pressure-mass flow phase relationship.
Figure 2B:
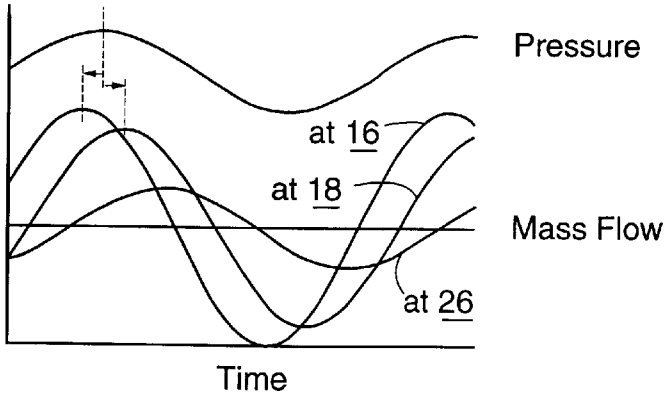
FIGS. 2A and 2B depict a PTR according to the present invention and pressure-mass flow phase relationship adjusted for efficient operation.
Figure 2A:
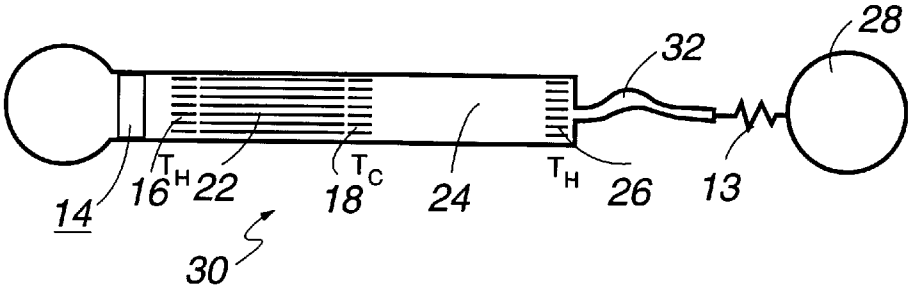

Referring now to FIG. 2A, one embodiment of our invention provides inertance 32 in series with a resistive element 13 to shift mass flow phase at cold heat exchanger 18, as shown in FIG. 2B. Resistive element 13 may be a valve, variable orifice, baffles, or any other device that provides a resistance to fluid movement. Further, as shown in FIG. 4, the use of inertia in acoustic transmission line 34 can be used to feed some of the power that would otherwise be dissipated in orifice 12 or resistive element 13 (FIGS. 1A and 2A, respectively) back to compressor 14. In other words, our invention reduces the effects of two of the three causes of reduced efficiency generally discussed above for PTRs. For purposes of this description, like numbered parts in FIGS. 2A, 3A, 3B, and 4 may not be identically fabricated, but perform like functions and may not be separately discussed for each figure.

In the harmonic approximation, where the oscillatory pressure and mass flow are considered to be essentially sinusoidal in time, a lumped-impedance model closely analogous to a simple ac electrical circuit illustrates the principle. See, e.g. L. E. Kinsler et al., *Fundamentals of Acoustics,* Chapter 10, "Resonators, Ducts, and Filters," pp. 225–243, John Wiley and Sons (1982). In the conventional PTR, an orifice or valve forms a purely resistive impedance and the reservoir volume is a compliance, analogous to an electrical capacitor. Oscillating pressure is analogous to oscillating voltage, and oscillatory volumetric mass flow is analogous to oscillating current.

As is often done in analysis of ac electric circuits, complex variables represent amplitudes and phases of oscillatory quantities. The amplitude of the oscillating pressure is $|p_1|$, the amplitude of the oscillating volumetric mass flow is $|U_1|$, and the phases of the complex numbers $p_1$, and $|U_1|$, reflect the time phases of the oscillations. The compliance of the reservoir is $$C=V/\gamma p_m$$

where V is the volume of the reservoir, $p_m$ is the mean pressure (i.e., the average pressure), and $\gamma$ is the ratio of isobaric to isochoric specific heats. The adiabatic compressibility of an ideal gas is $1/\gamma p_m$. Just as in an electrical circuit, the complex impedance of a compliance is $Z_c=1/j\omega C$, where $j=\sqrt{-1}$ and $\omega=2\pi f$, with $f$ denoting the frequency of the oscillations. Hence, the impedance of a compliance is a negative imaginary number, so the impedance Z of the RC "circuit" formed by orifice 12 and compliance reservoir 28 (FIG. 1A) must lie in the fourth quadrant in a plot of Im(Z) vs. Re(Z), i.e., a negative phase shift in the complex impedance plane. In practice, before the present invention, the highest efficiency PTRs have required that Z be as real as possible, so the compliance reservoir volume was typically rather large to provide a large C and a concomitant small $Z_c$.

In one aspect of the present invention, an inertance 32 is placed in series with resistive element 13 (FIG. 2A) to allow access to the first quadrant (positive phase shift) in the complex impedance plane. The simplest inertance is a tube of length l, filed with a gas having density $\rho$, and cross-sectional area A, in which the inertia of the moving gas contributes an inertance $$L=\rho l/A \tag{2}$$

In K. M. Godshalk et al., "Characterization of 350 Hz Thermoacoustic Driven Orifice Pulse Tube Refrigerator with Measurements of the Mass Flow and Pressure," 41 Adv in Cryogenic Eng. (1996), pp.1411–1418, the effect of the inertance of the pulse tube itself on the phase angle between the mass flow and pressure at the cold end of the pulse tube is discussed. It was found that a pulse tube could be designed to obtain phasing of the mass flow similar to the phasing found in a Stirling cycle refrigerator; i.e., the mass flow leads the pressure at the warm end of the regenerator and lags the pressure at the cold end of the regenerator. This was found to be feasible at 350 Hz due to the shorter wavelength of sound in helium at this high frequency.

The complex impedance of an inertance $Z_L=j\omega L$ is proportional to frequency so that the relatively high operating frequency of the Godshalk device made the effect of the pulse tube inertance readily apparent. But conventional PTRs operate at frequencies well below 350 Hz and typically below 120 Hz. Our invention permits inertance effects to be realized and phase control obtained at frequencies much lower than 350 Hz. FIG. 2A illustrates a PTR 30 having a separate inertance 32, in accordance with this invention. PTR 30 is generally a conventional PTR with hot end piston 14, a regenerator 22, hot 16 and cold 18 heat exchangers at opposite ends of regenerator 22, pulse tube 24 and hot heat exchanger 26. Inertance is introduced by the addition of separate acoustic inertance 32 in series with resistance 13 and compliance reservoir 28. As shown in FIG. 2B, the mass flow of the operating fluid is advantageously phase shifted relative to the fluid pressure.

This occurs because the inertance causes the mass flow phase at heat exchanger 26 to lag the pressure phase, as shown in FIG. 2B. Thus, even though the mass flow phase at cold heat exchanger 18 lags that at heat exchanger 26, it can still lead the pressure phase. For most efficient operation, the mass flow phase at hot heat exchanger 16 lags the pressure phase slightly, as also shown in FIG. 2B.

Inertance 32 and resistance 13 may be formed as a variable complex impedance network, e.g., with a fixed inertance and variable acoustic resistance elements $R_s$ and $R_p$, as shown and discussed below for FIG. 5A. However, it will be appreciated from the discussion below that substantial areas of the first quadrant of the complex acoustic impedance plane can be accessed by any similar network having two variable values: a fixed inertance and variable resistors $R_s$ and $R_p$, a variable inertance and variable $R_s$, or a variable inertance and variable $R_p$.

Figure 3B:
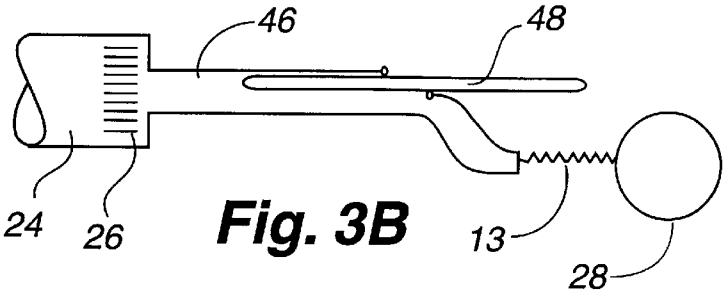
FIGS. 3A and 3B depict exemplary embodiments of variable acoustic inertances.
Figure 4:
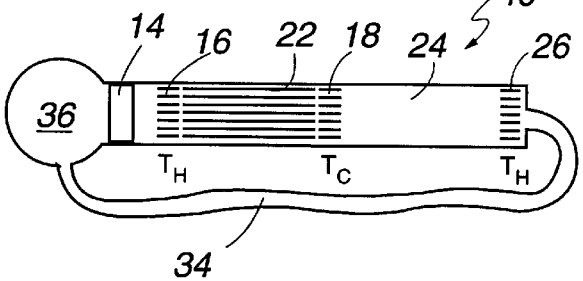
FIG. 4 depicts a PTR with an acoustic transmission line for energy return according to one aspect of the present invention.
Figure 3A:
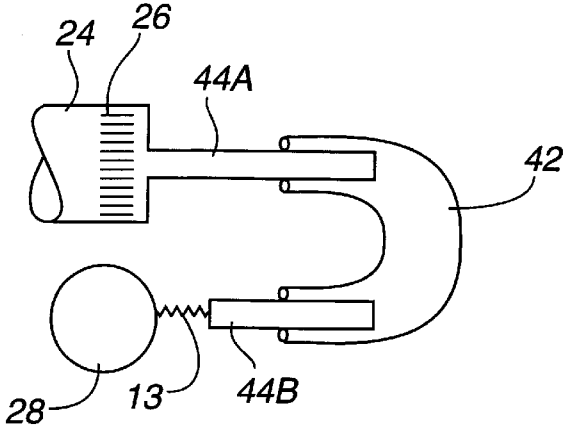

A variable inertance may be formed as shown in FIGS. 3A and 3B. FIG. 3A illustrates a variable length tube, which may be conveniently formed by a trombone slide 42, interacting with fixed tube segments 44A and 44B. FIG. 3B illustrates a variable area tube, where rod 48 slides within tube 46 to obtain a variable average cross-sectional area for fluid flow in tube 46 and a concomitant variable acoustic inertance.

Figure 5B:
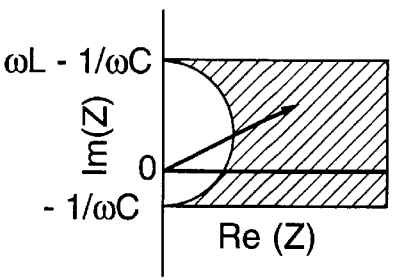
FIGS. 5A and 5B schematically depict a variable impedance network and phase diagram according to one embodiment of the present invention.
Figure 5A:
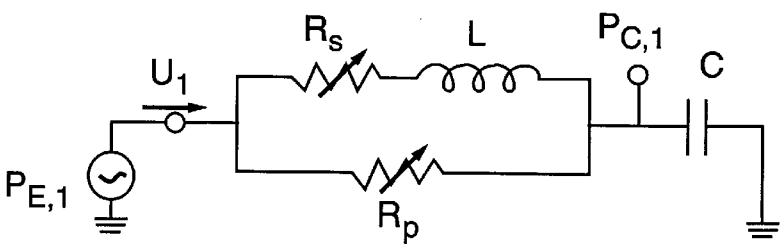

In one exemplary design of a large PTR with 4 kW of gross cooling power, $p_m$=3.1 MPa helium at 40 Hz, with $|p_1|/p_m \cong 0.10$ at the hot end of the regenerator and $|p_1|/p_m \cong 0.09$ at the entrance to the orifice, it is estimated that the power required to drive the refrigerator would be reduced by up to 20% when the phase of Z, at the orifice, is shifted from 0° (prior art shown in FIG. 1A) to +25° (embodiment of invention shown in FIG. 5A).

To verify that the realization of such a phase shift is possible, without investment in expensive hardware, an impedance network was constructed in the configuration of FIG. 5A having globe orifice valves for resistance $R_s$ and $R_p$, a right circular cylinder reservoir for compliance C, and tubing for inertance L. The apparatus was designed to be similar, in the strictest technical sense of the word, to the design required for the 4 kW helium design, but at greatly reduced power. A half-scale model was built, filled with 2.5 MPa argon and operated at 23 Hz with $|p_1|/p_m \cong 0.09$ at the entrance to the impedance network. This is accurately similar to the full-scale, 40 Hz, 3 MPa helium design with $|p_1|/p_m \cong 0.09$. The primary advantage of the half-scale model is that all powers are reduced by a factor of 16, so that only 250 W must be supplied to test the behavior of the 4 kW application. All dimensionless variables, such as Reynolds' number, Mach number, and length ratios, are identical so that the physics in the model is the same as for full scale.

For the test apparatus, a thermoacoustic driver was used (see, e.g., G. Swift, "Analysis and Performance of a Large Thermoacoustic Engine," 92 J.Acoust. Soc. Am., pp 1405 (1992)) rather than a piston drive. But the nature of the source of oscillating pressure is irrelevant for this invention.

In a first 23 Hz test apparatus, the inertance was a 2 meter length of copper tubing with 1.1 cm inside diameter, so that L=8.6×105 kg/m$^5$ and $\omega L=1.2\times10^8$ Pa-sec/m$^3$. With l approximately equal to $\lambda/2\lambda$(where $\lambda=a/f$ is the wavelength of sound and a is the speed of sound), this inertance actually has some transmission line characteristics (a 4% effect). The compliance reservoir was a right circular cylinder with internal volume $V=2.3\times10^{-3}$ m$^3$, so that $C=5.5\times10^{-10}$ m$^4$ sec$^2$/kg and $1/\omega C=1.2\times10^7$ Pa-sec/m$^3$.

To permit variation of both magnitude and phase of the complex impedance, an acoustic impedance network with inertance L and compliance C was formed in the configuration shown in FIG. 5A, with two variable resistances (i.e., valves) $R_p$ and $R_s$. This configuration allowed the complex impedance Z of the impedance network to be set at desired points within the shaded area in FIG. 5B. When the value of $R_p$ is infinite (i.e., valve $R_p$ is closed), only the series combination of $R_s$, L, and C contributes to the impedance.

Since L and C are fixed by physical dimensions and gas characteristics, this case provided an upper bound for the imaginary part of Z in FIG. 5B:

$$Im(Z) \leqq \omega L - 1/\omega C \cong 1.1\times10^5 \text{ Pa-sec/m}^3.$$

Similarly, when $R_s$ is infinite, only $R_p$ and C contribute to the impedance. This provided the lower bound in FIG. 5B:

$$Im(Z) \geqq -1/\omega C \cong 1.2\times10^7 \text{ Pa-sec/m}^3.$$

Figure 6A:
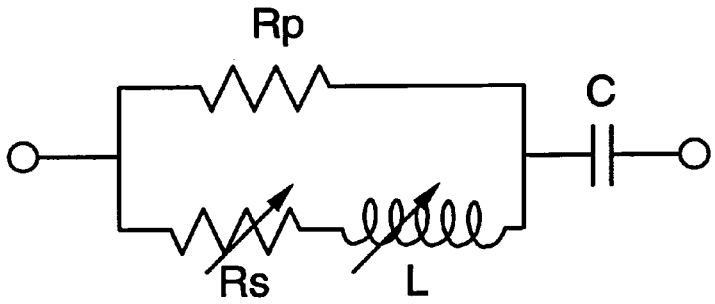
FIGS. 6A, 6B, and 6C schematically represent various combinations of resistance, inertance, and compliance that provide phase control in accordance with the present invention.
Figure 6B:
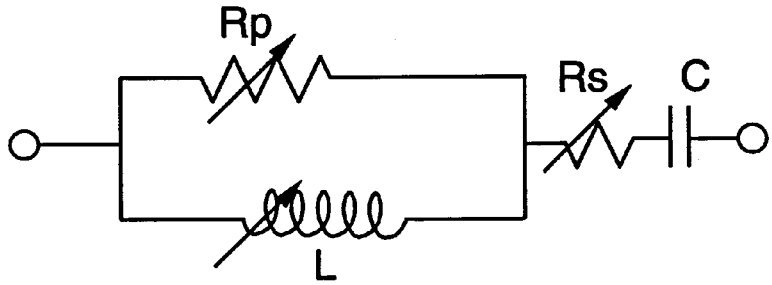
Figure 6C:
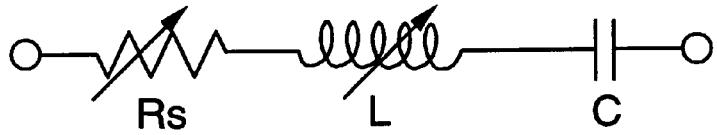

The networks shown in FIGS. 6A, 6B, and 6C also permit access to the first quadrant in the complex impedance plane. The complex impedance values below arise from the connected relationships between inertance (L), series resistance ($R_s$), parallel resistance ($R_p$), and compliance (C) shown in FIGS. 6A, 6B, and 6C:

| | |
|---|---|
| FIG. 6A | $Z = \frac{R_p(R_s + j\omega L)}{R_s + R_p + j\omega L} + \frac{1}{j\omega C}$ |
| FIG. 6B | $Z = \frac{j\omega L R_p}{R_p + j\omega L} + R_s + \frac{1}{j\omega C}$ |
| FIG. 6C | $Z = R_s + j\omega L + \frac{1}{j\omega C}$ |

Referring again to FIGS. 5A and 5B, dynamic pressure transducers measuring $P_{E,1}$ and $P_{c,1}$, were located at the entrance to this impedance network and in the compliance, respectively, in order to determine the network impedance $Z=p_{E,1}/U_1$ and the power $$\dot{E} = \frac{1}{2}\mathrm{Re}(p_{E,1}\tilde{U}_1)$$

absorbed by the impedance, where the tilde denotes the complex conjugate and Re denotes the real part of the argument. The oscillatory volumetric mass flow $U_1$ was determined from the pressure oscillations in the compliance: The oscillatory volumetric mass flow $U_1$ into the compliance delivers an extra mass $m_1=\rho U_1/j\omega$ to the compliance, so the gas density in the compliance oscillates as $\rho_1=m_1/V=\rho U_1/j\omega V$. These oscillations in the compliance are nearly adiabatic, so the compressibility of the gas in the compliance is $1/\gamma p_m$. Hence the oscillating density $\rho_1$ causes an oscillating pressure $p_{c,1}=\rho_1\gamma p_m/\rho=U_1\gamma p_m/j\omega V$. Solving for volumetric mass flow yields $$U_1 = \frac{j\omega V}{\gamma p_m} p_{c,1} \qquad \text{Eq. (3)}$$

The complex impedance and the power are therefore given by $$Z = \frac{p_{E,1}}{U_1} = \frac{\gamma p_m}{j\omega V}\frac{p_{E,1}}{p_{c,1}} \text{ and} \qquad \text{Eq. (4)}$$

$$\dot{E} = \frac{\omega V}{2\gamma p_m}\mathrm{Im}(p_{E,1}\tilde{p}_{c,1}) \qquad \text{Eq. (5)}$$

One-inch globe valves were used as the variable resistances $R_p$ and $R_s$ in the first test apparatus. Copper tubing through which cooling water flowed was wrapped around the valves to remove the heat generated by the oscillating gas passing through the valves. The network end of the thermoacoustic engine was similarly wrapped for cooling purposes. The valves were set at a variety of openings, the thermoacoustic driver was adjusted to maintain $|p_{E,1}|\approx0.08p_m$, the complex pressures $p_{E,1}$, and $p_{c,1}$, were measured, and values of impedance were calculated using Eq. (4). The results are shown in FIG. 6. The circles tangent to the imaginary axis in FIG. 7, calculated using Eq. (5), represent contours of equal power delivered to the impedance network at an acoustic pressure amplitude $p_{E,1}=0.08p_m$.

Figure 7:
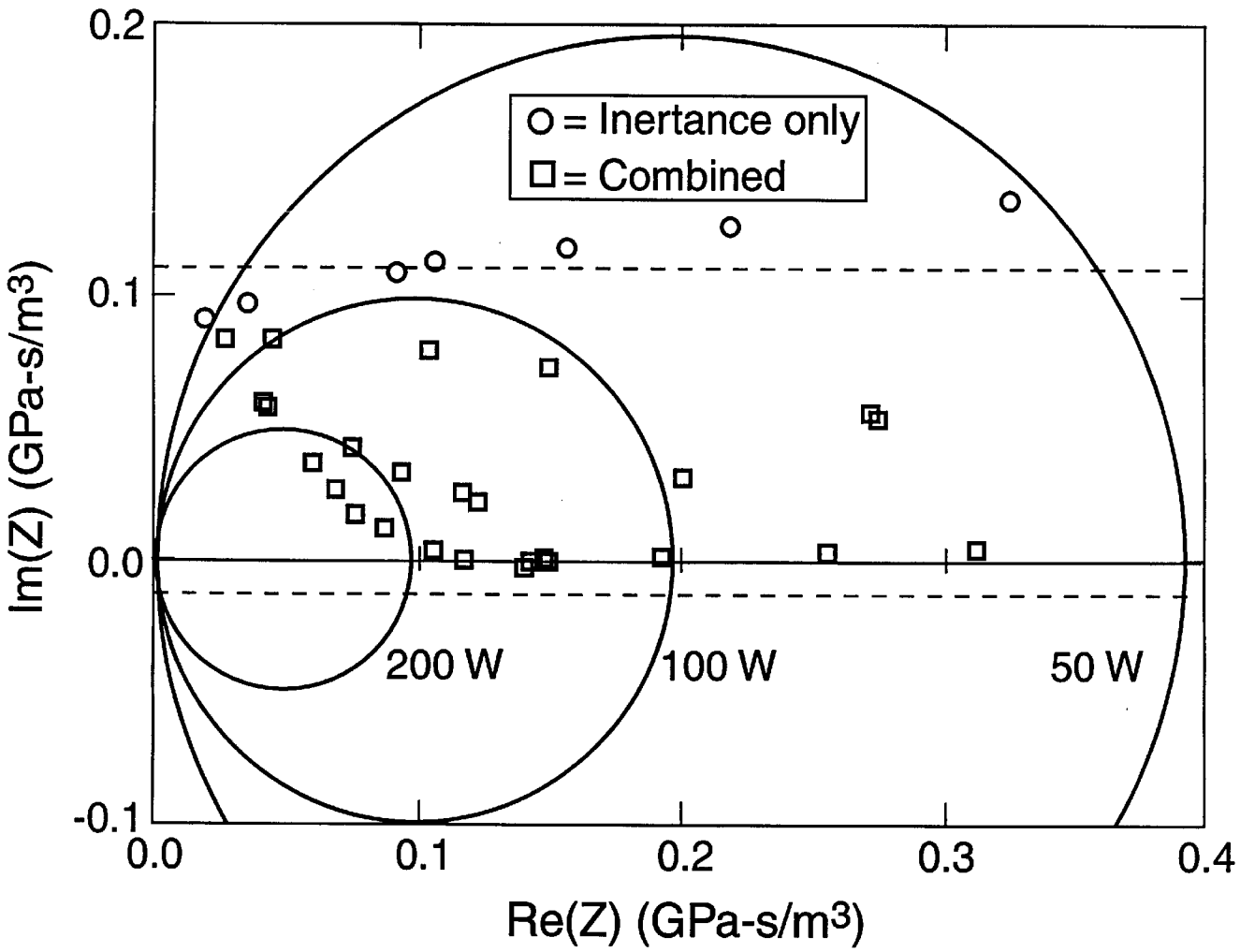
FIG. 7 is a complex impedance diagram showing experimental results using the embodiment shown in FIG. 5A.

In FIG. 7, the experimental data are separated into two categories. With $R_s$ exercised and $R_p$ closed, the data are denoted as "Inertance Only" (open circles). These data are near the expected upper bound of Im(Z) discussed above. When $R_p$ and $R_s$ are both exercised, the data are denoted as "Combined" (open squares). These data cover a wide area of the complex impedance plane; intermediate points in the plane are accessible by suitable choices of openings of the two valves.

The leftmost "Inertance only" point represents the impedance with valve $R_p$ closed and valve $R_s$ fully open. In this case, Re(Z) represents the loss in the inertance itself due to turbulence and viscous dissipation in the tube. For this large tube, the internal loss is small enough that the phase of Z can be greater than 85°.

As shown in FIG. 7, it is possible to adjust both the phase and magnitude of the network impedance over broad ranges, which is identical to adjusting the complex ratio of pressure amplitude to volumetric mass flow in a PTR load. Because of the scale factor (factor of 16 here), this invention clearly will work for a 4 kW application using helium.

Figure 8:
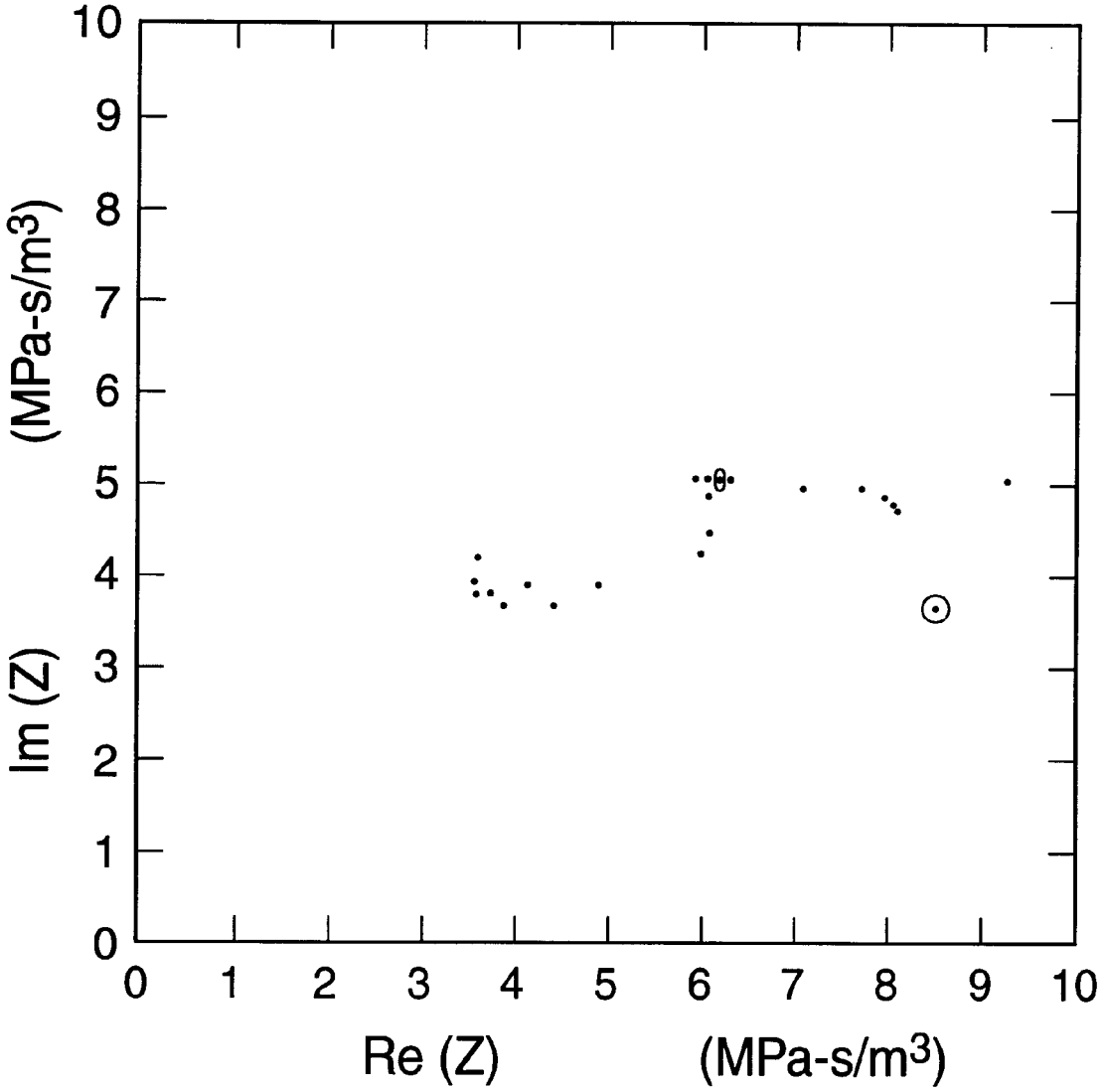
FIG. 8 is a complex impedance diagram showing experimental results from an inertance with parallel variable valve resistances.

For a large PTR with the configuration shown in FIG. 5A, currently being tested with 3 MPa helium at 40 Hz, values of Z determined from Eq. (4) and using measured values of $p_{E,1}$ and $P_{c,1}$ are shown in FIG. 8. These values of Z were obtained by adjustment of $R_s$ and $R_p$ over selected, narrow ranges of all possible adjustments. Positive phase shifts were clearly obtained. One exemplary operating point (circled at lower right in FIG. 8) provided 1275 W of cooling power as measured by the liquefaction rate of a natural gas stream, while requiring 13 kW of input power to the PTR from a thermoacoustic driver. Another exemplary operating point (circled in the middle of FIG. 8) provided 1515 W of cooling power while requiring 12.6 kW of input power. This is the most powerful PTR ever reported.

Most applications for PTRs require orders of magnitude less gross cooling power than 4 kW, and hence orders of magnitude larger impedance. Difficulties arise at large inertance $L=\rho l/A$, for two reasons: l cannot be increased beyond roughly $\lambda/2\pi$, and A cannot be decreased to the point that dissipative effects overwhelm inertial effects.

Figure 9A:
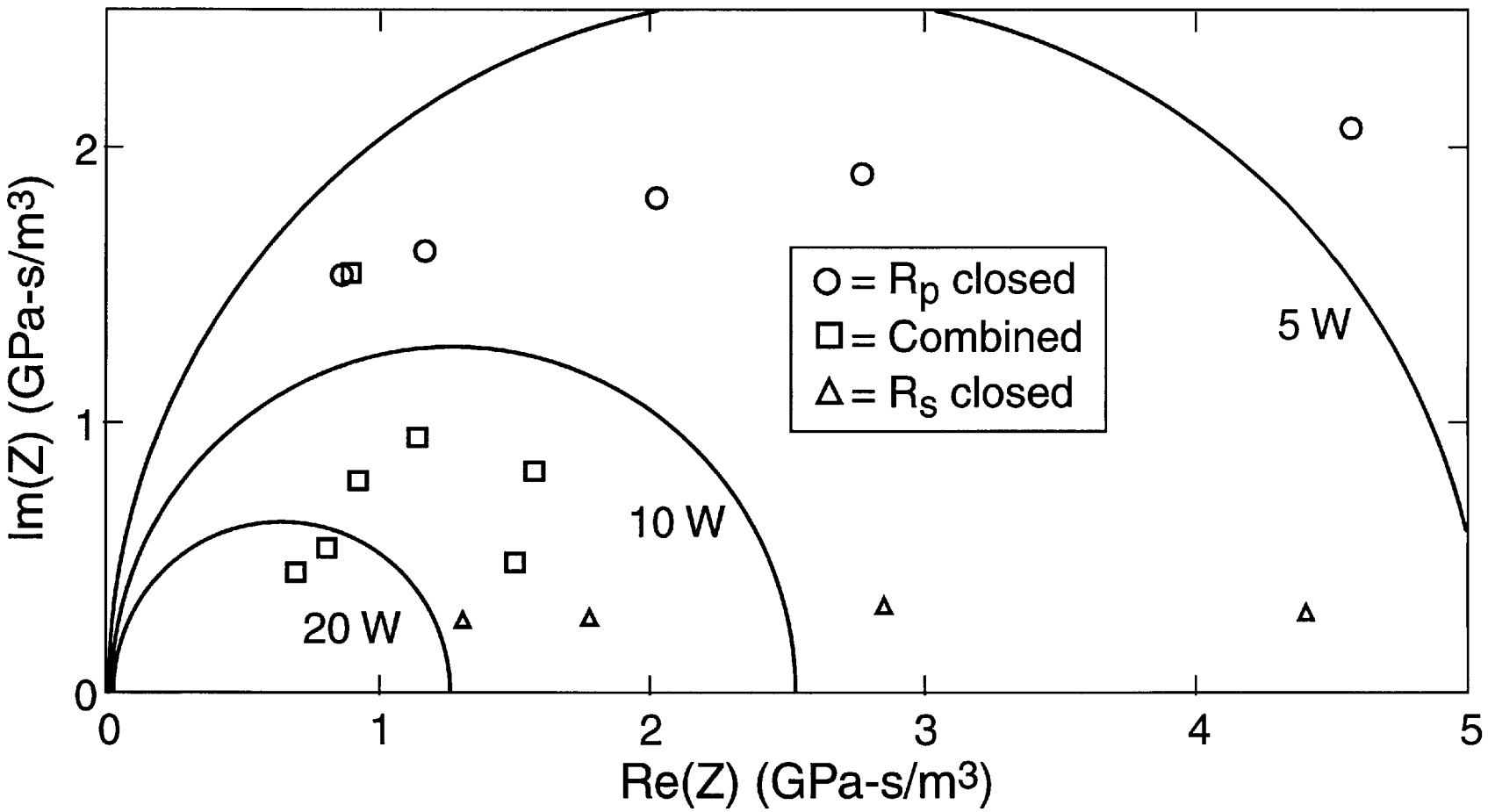
FIGS. 9A and 9B are complex impedance diagrams showing experimental results.

Larger values for L, $R_p$ and $R_s$ were tried in the above test apparatus for a small PTR. Tubing inner diameters of 3.3 mm and 1.7 mm were used, each 2 m long, resulting in $L=9.6\times10^6$ kg/m$^4$, and $L=3.6\times10^7$ kg/m$^4$, respectively. Data for each are presented in FIGS. 9A and 9B.

In each case, the small section of tubing required when connecting valve $R_p$ to the compliance has sufficient nuisance inertance to overwhelm the large compliance (which was sized for the earlier experiments shown in FIG. 7); accordingly, impedance data denoted as "Rs Closed" have positive imaginary Z. As evident in FIGS. 9A and 9B, a variety of phase angles and powers delivered to the load are available using appropriate adjustments of the valves $R_p$ and $R_s$. Indeed, it appears that all impedances between the triangles and the circles are accessible by suitable adjustment of $R_p$ and $R_s$.

Figure 9B:
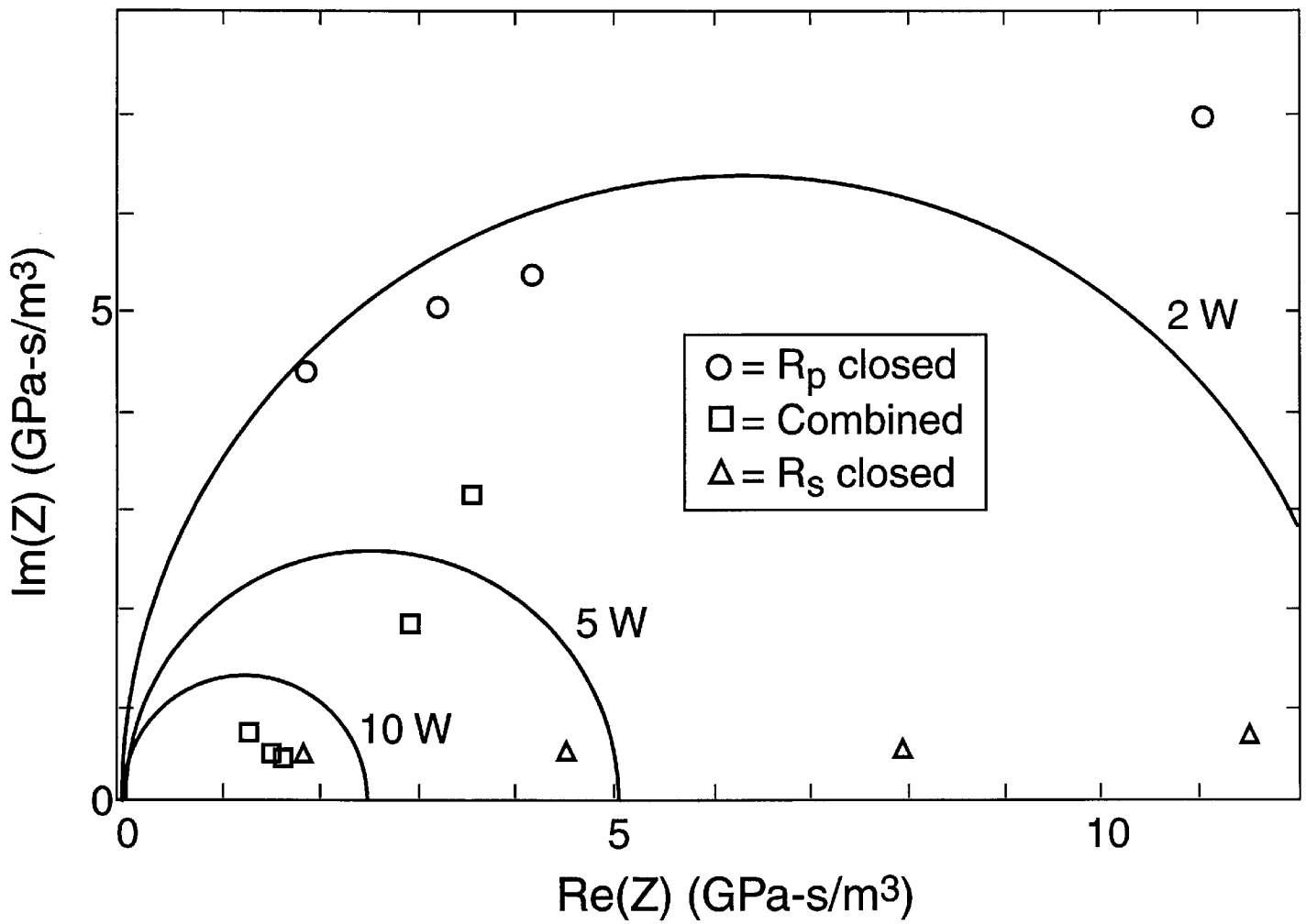

FIG. 9B shows that the phase of Z can be near 70° even for scale powers as low as 2 W (equivalent to an operating power of 32 W in a full-scale helium PTR), further showing the usefulness of inertance for improving the efficiency of PTRs.

Further use of inertial effects to improve PTR efficiency is illustrated in FIG. 4, where an acoustic transmission line 34 recovers power that would otherwise be dissipated in an orifice in previous PTRs back to volume 36 for input to compressor 14. Acoustic transmission line 34 is analogous to an electric transmission line; its nature is most simply appreciated by a lumped LC impedance approximation. An acoustic transmission line can transmit acoustic power while changing the relative magnitude and phase of $p_1$ and $U_1$. The boundary between the "inertance" picture and the "transmission line" picture is not exact, but roughly occurs near $l=\lambda/2\lambda$: shorter lengths for acoustic transmission line 34 behave essentially as a lumped inertance with $U_1$ independent of position in the tube, and longer lengths behave essentially as transmission lines, with significant dependence of $U_1$ on position. However, lumped inertances such as the 2-m long tubes discussed above have slight transmission-line character, and transmission lines with length not much greater than $\lambda/2\pi$ and located not too near a pressure anti-node have much in common with lumped inertances.

FIG. 4 illustrates feedback of power to the back side 36 of compressor piston 14. Most piston compressors in use for PTRs have such a "back side" already, filled with the working gas, so that leakage past compressor piston 14 does not result in loss of working gas from the system and so that the piston does not have to support a large average pressure difference, such as from 3 MPa to atmospheric pressure.

Typically, back side 36 of compressor 14 contains a volume of working gas roughly comparable to the volume of the PTR 40 assembly. In one computer simulation, it was assumed that back volume 36 was three times larger than PTR 40 volume, so that the amplitude of the pressure oscillations in back volume 36 was about ⅓ the amplitude of the oscillations in PTR 40, and about 180° out of phase. This calculation was done for a 40 Hz, 3.1 MPa helium PTR having almost 1 kW of cooling power. The pressure oscillations at hot end 16 of regenerator 22 were assumed to be 310 kPa in amplitude, with a phase of −90° (with respect to an arbitrary reference phase). PTR design calculations indicated that the pressure oscillations at end 26 of pulse tube 24 should be 276.5 kPa in amplitude at a phase of −92.40, with a volumetric mass flow of $8.32\times10^{-3}$ $m^3/s$ at −122.0° for best thermodynamic performance of PTR 40.

Under these conditions, 1 kW of acoustic power must be removed from end 26 of pulse tube 24; without the use of transmission line 34 (i.e., in a configuration such as FIG. 2A) this power would be absorbed in resistance 13 and converted into waste heat. Compressor back volume 36 ensured that the pressure oscillations in back volume 36 would have an amplitude of 100 kPa at a phase of +90°. Hence, the design of transmission line 34, assuming that it had to connect between a first location with 276.5 kPa in pressure amplitude at a phase of −92.4°, with volumetric mass flow $8.32\times10^{-3}$ $m^3/s$ at a phase of −122°, and a second location with 100 kPa at +90°, causes line 34 to transmit as much of the 1 kW power as possible from the first location to the second location. Calculations show that a transmission line comprised of two tubes in series (one tube with 1.65 cm diameter and 7.89 m long connected in series with a downstream tube with 3.71 cm diameter and 3.44 m long) will deliver 814.9 W of acoustic power back to the compressor. The remaining 185.1 W is absorbed by turbulent losses in transmission line 34 and converted to waste heat.

Power can also be fed back to a thermoacoustic compressor, such as would be used in the thermoacoustic cryocooler described in U.S. Pat. No. 4,953,366. In this case, transmission line 34 can be attached to the thermoacoustic resonator at a location where the pressure amplitude in the standing wave has a suitable amplitude and phase.

It is important to realize that this feedback-of-power idea achieves two efficiency advantages for PTRs: it retains the advantage of favorable phase shift between $p_1$ and $U_1$ at the cold end of the PTR, described in the inertance discussions above, and it provides additional efficiency improvement by returning power to the compressor which would otherwise be dissipated in a prior-art PTR or in a PTR with simple inertance.

The embodiments of FIGS. 5A and 6A–6C with at least two of L, $R_s$ and $R_p$ variable (such as by using valves), are preferred for cases where the PTR must be operated at various cooling powers and cold temperatures, because these embodiments provide real-time control of both magnitude and phase of Z. An R-L series embodiment with R variable and L variable (see FIGS. 3A, 3B, and 6C) may also be used for the same situations.

For power feedback to the driver, an acoustic transmission line in the form of one tube or two tubes in series is preferred for simplicity and high efficiency. More complicated systems, including lumped LC systems, would also work. Adjustability can be provided with one or more valves and/or tubing have variable length and/or area, as discussed above for variable inertance.

Accordingly, a primary advantage of our invention is increased efficiency in PTRs by providing optimal phasing between $p_1$ and $U_1$ at the cold end of the regenerator, without in any way compromising the simplicity and low cost of PTRs. This advantage is especially important for PTRs with very low cold temperature such as 100 K.

A secondary advantage is the ability to reduce the size of the compliance reservoir without decreasing the efficiency. This is possible because a positive imaginary impedance $j\omega L$ can cancel a negative imaginary impedance $1/j\omega C$.

Another secondary advantage is the freedom to enlarge the pulse tube without sacrificing phase shift between pressure and mass flow at the cold heat exchanger. An enlarged pulse tube may permit an increase of the ratio of net-to-gross cooling power, with even higher resultant PTR efficiency.

An advantage of the two-valve embodiment or the valve-plus-slide-trombone embodiment is the ability to adjust both magnitude and phase of the total impedance over wide ranges while the PTR is operating.

A primary advantage of the acoustic transmission line feedback is a further increase in efficiency. For large PTRs, this is as important as the primary advantage, above; for small PTRs, this is less than the primary advantage. For large PTRs at relatively high cold temperature, such as near 200 K, for food deep freezers or for precooling of gas in preparation for liquefaction in a further stage of refrigeration, feedback (with due attention to the phase between $p_1$ and $U_1$ at the cold end) can improve the efficiency of PTRs by a factor of 2.

A further advantage of the acoustic transmission line feedback is the elimination of the compliance reservoir.

The foregoing description of the invention has been presented for purposes of illustration and description and is not intended to be exhaustive or to limit the invention to the precise form disclosed, and obviously many modifications and variations are possible in light of the above teaching.

The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. In a pulse tube refrigerator having a pulse tube with an oscillating mass flow for energy transfer and a reservoir with a volume defining a compliance value C, an improvement comprising a variable acoustic impedance connecting said pulse tube in series with said reservoir;

said variable acoustic impedance including a tube member having a diameter and length forming an inertance with a value L and a variable resistive member having a first series resistive member $R_s$ and a second parallel resistive member $R_p$, said inertance, first resistive member, and said resistive member connected to form an impedance Z selected from $$Z = \frac{R_p(R_s + j\omega L)}{R_s + R_p + j\omega L} + \frac{1}{j\omega C}, \quad \text{and}$$

$$Z = \frac{j\omega L R_p}{R_p + j\omega L} + R_s + \frac{1}{j\omega C},$$

where $j=\sqrt{-1}$ and $\omega$ is the radian frequency of said oscillating mass flow, wherein said acoustic impedance formed by the values C, L, $R_s$ and $R_p$ provides a phase angle between fluid pressure and mass flow that is variable to optimize cooling power of said pulse tube refrigerator.

2. A pulse tube refrigerator according to claim 1, wherein at least one of said resistive member $R_s$ and said resistive member $R_p$ is variable.

3. A pulse tube refrigerator according to claim 1, wherein said inertance is a variable inertance.

4. A pulse tube refrigerator according to claim 3, wherein said variable inertance is formed from slidingly connected tube members to provide a variable length tube.

5. A pulse tube refrigerator according to claim 3, wherein said variable inertance is formed from a tube member and a sliding member engaging said tube member to provide a variable average cross-sectional area in said tube member as said sliding member is moved within said tube member.

6. A pulse tube refrigerator according to claim 1, wherein said second resistive member $R_p$ is an open circuit and said first resistive member $R_s$ and said inertance L are connected to form an acoustic impedance $$Z = R_s + j\omega L + \frac{1}{j\omega C}.$$

.

7. A pulse tube refrigerator according to claim 6, wherein said inertance is a variable inertance formed from slidingly connected tube members to provide a variable length tube.

8. A pulse tube refrigerator according to claim 6, wherein said inertance is a variable inertance formed from a tube member and a sliding member engaging said tube member to provide a variable average cross-sectional area in said tube member as said sliding member is moved within said tube member.

9. In a pulse tube refrigerator having a hot end driver for establishing an oscillating mass flow of a fluid within said refrigerator, a regenerator for receiving said oscillating mass flow for heat transfer with said fluid, and a pulse tube, an improvement comprising an acoustic transmission line having a length greater than about $\lambda/2\pi$, where $\lambda$ is the wavelength of said oscillating mass flow and connecting said pulse tube with said driver for returning power from said pulse tube to said driver.

* * * * *